US011391070B2

(12) United States Patent
Grant et al.

(10) Patent No.: US 11,391,070 B2
(45) **Date of Patent: *Jul. 19, 2022**

(54) KEY AND SECURITY DEVICE

(71) Applicant: InVue Security Products Inc., Charlotte, NC (US)

(72) Inventors: Jeffrey A. Grant, Charlotte, NC (US); Christopher J. Fawcett, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/238,961

(22) Filed: Apr. 23, 2021

(65) Prior Publication Data

US 2021/0238893 A1 Aug. 5, 2021

Related U.S. Application Data

(63) Continuation of application No. 16/872,981, filed on May 12, 2020, now Pat. No. 11,015,373, which is a (Continued)

(51) Int. Cl.
*E05B 73/00* (2006.01)
*G08B 25/00* (2006.01)

(Continued)

(52) U.S. Cl.
CPC ..... *E05B 73/0047* (2013.01); *A47F 13/00* (2013.01); *E05B 73/0017* (2013.01);

(Continued)

(58) Field of Classification Search
None
See application file for complete search history.

(56) References Cited

U.S. PATENT DOCUMENTS 883,335 A 3/1908 O'Connor
3,444,547 A 5/1969 Surek (Continued)

FOREIGN PATENT DOCUMENTS

CA 2465692 A1 11/2004
CN 201297072 Y 8/2009

(Continued)

OTHER PUBLICATIONS

Petition for Inter Partes Review of U.S. Pat. No. 8,896,447, May 22, 2015, 62 pages (IPR 2015-01263).

(Continued)

*Primary Examiner* — K. Wong
(74) *Attorney, Agent, or Firm* — InVue Security Products Inc.

(57) ABSTRACT

A key for a security device is provided. The key may include an electronic component configured to communicate with one or more security devices to initially receive one or more codes associated with each of the security devices. The key may also include a memory configured to store the one or more codes associated with the one or more security devices. The electronic component is configured to communicate with each of the one or more security devices for arming and/or disarming the security devices upon a matching of the code stored by the memory with the code associated with the security device.

20 Claims, 3 Drawing Sheets

Related U.S. Application Data continuation of application No. 16/110,843, filed on Aug. 23, 2018, now abandoned, which is a continuation of application No. 15/526,194, filed as application No. PCT/US2015/058941 on Nov. 4, 2015, now Pat. No. 10,087,659.

(60) Provisional application No. 62/081,233, filed on Nov. 18, 2014.

(51) Int. Cl.

| | |
|---|---|
| ***G08B 13/14*** | (2006.01) |
| ***A47F 13/00*** | (2006.01) |
| *A47F 3/00* | (2006.01) |
| *G07C 9/00* | (2020.01) |
| *E05B 47/00* | (2006.01) |

(52) U.S. Cl.

CPC ..... *G08B 13/1445* (2013.01); *G08B 25/008* (2013.01); *A47F 3/002* (2013.01); *E05B 2047/0094* (2013.01); *G07C 9/00944* (2013.01)

(56) References Cited

U.S. PATENT DOCUMENTS

| | | | |
|---|---|---|---|
| 3,493,955 | A | 2/1970 | Minasy |
| 3,641,498 | A | 2/1972 | Hedin |
| 3,685,037 | A | 8/1972 | Bennett |
| 3,780,909 | A | 12/1973 | Callahan et al. |
| 3,848,229 | A | 11/1974 | Perron et al. |
| 4,117,465 | A | 9/1978 | Timblin |
| 4,250,533 | A | 2/1981 | Nelson |
| 4,286,305 | A | 8/1981 | Pilat et al. |
| 4,354,613 | A | 10/1982 | Desai et al. |
| 4,486,861 | A | 12/1984 | Harmel |
| 4,573,042 | A | 2/1986 | Boyd et al. |
| 4,686,513 | A | 8/1987 | Farrar et al. |
| 4,800,369 | A | 1/1989 | Gomi |
| 4,851,815 | A | 7/1989 | Enkelmann |
| 4,853,692 | A | 8/1989 | Wolk |
| 4,926,665 | A | 5/1990 | Stapley et al. |
| 4,980,671 | A | 12/1990 | McCurdy |
| 5,005,125 | A | 4/1991 | Farrar et al. |
| RE33,873 | E | 4/1992 | Romano |
| 5,117,097 | A | 5/1992 | Kimura et al. |
| 5,140,317 | A | 8/1992 | Hyatt et al. |
| 5,151,684 | A | 9/1992 | Johnsen |
| 5,170,431 | A | 12/1992 | Dawson |
| 5,182,543 | A | 1/1993 | Siegel et al. |
| 5,245,317 | A | 9/1993 | Chidley |
| 5,367,289 | A | 11/1994 | Baro et al. |
| 5,479,799 | A | 1/1996 | Kilman et al. |
| 5,543,782 | A | 8/1996 | Rothbaum et al. |
| 5,570,080 | A | 10/1996 | Inoue |
| 5,589,819 | A | 12/1996 | Takeda |
| 5,610,587 | A | 3/1997 | Fujiuchi et al. |
| 5,640,144 | A | 6/1997 | Russo et al. |
| 5,650,774 | A | 7/1997 | Drori |
| 5,656,998 | A | 8/1997 | Fujiuchi et al. |
| 5,701,828 | A | 12/1997 | Benore et al. |
| 5,710,540 | A | 1/1998 | Clement et al. |
| 5,745,044 | A | 4/1998 | Hyatt et al. |
| 5,748,083 | A | 5/1998 | Rietkerk |
| 5,764,147 | A | 6/1998 | Sasagawa et al. |
| 5,767,773 | A | 6/1998 | Fujiuchi et al. |
| 5,793,290 | A | 8/1998 | Eagleson et al. |
| 5,808,548 | A | 9/1998 | Sasagawa et al. |
| 5,836,002 | A | 11/1998 | Morstein et al. |
| 5,838,234 | A | 11/1998 | Roulleaux-Robin |
| 5,864,290 | A | 1/1999 | Toyomi et al. |
| 5,905,446 | A | 5/1999 | Benore et al. |
| 5,942,978 | A | 8/1999 | Shafer |
| 5,942,985 | A | 8/1999 | Chin |
| 5,955,951 | A | 9/1999 | Wischerop et al. |
| 5,964,877 | A | 10/1999 | Victor et al. |
| 5,982,283 | A | 11/1999 | Matsudaira et al. |
| 6,005,487 | A | 12/1999 | Hyatt et al. |
| 6,020,819 | A | 2/2000 | Fujiuchi et al. |
| 6,037,879 | A | 3/2000 | Tuttle |
| 6,043,744 | A | 3/2000 | Matsudaira |
| 6,104,285 | A | 8/2000 | Stobbe |
| 6,118,367 | A | 9/2000 | Ishii |
| 6,122,704 | A | 9/2000 | Hass et al. |
| 6,137,414 | A | 10/2000 | Federman |
| 6,144,299 | A | 11/2000 | Cole |
| 6,255,951 | B1 | 7/2001 | De La Huerga |
| 6,269,342 | B1 | 7/2001 | Brick et al. |
| 6,275,141 | B1 | 8/2001 | Walter |
| 6,300,873 | B1 | 10/2001 | Kucharczyk et al. |
| 6,304,181 | B1 | 10/2001 | Matsudaira |
| 6,308,928 | B1 | 10/2001 | Galant |
| 6,331,812 | B1 | 12/2001 | Dawalibi |
| 6,346,886 | B1 | 2/2002 | De La Huerga |
| 6,362,726 | B1 | 3/2002 | Chapman |
| 6,380,855 | B1 | 4/2002 | Ott |
| D457,051 | S | 5/2002 | Davis |
| 6,384,711 | B1 | 5/2002 | Cregger et al. |
| 6,420,971 | B1 | 7/2002 | Leck et al. |
| 6,433,689 | B1 | 8/2002 | Hovind et al. |
| 6,441,719 | B1 | 8/2002 | Tsui |
| 6,474,117 | B2 | 11/2002 | Okuno |
| 6,474,122 | B2 | 11/2002 | Davis |
| 6,512,457 | B2 | 1/2003 | Irizarry |
| 6,525,644 | B1 | 2/2003 | Stillwagon |
| 6,531,961 | B2 | 3/2003 | Matsudaira |
| 6,535,130 | B2 | 3/2003 | Nguyen et al. |
| 6,564,600 | B1 | 5/2003 | Davivs |
| 6,578,148 | B1 | 6/2003 | Beuchat et al. |
| 6,604,394 | B2 | 8/2003 | Davis |
| 6,615,625 | B2 | 9/2003 | Davis |
| 6,677,852 | B1 | 1/2004 | Landt |
| 6,718,806 | B2 | 4/2004 | Davis |
| 6,819,252 | B2 | 11/2004 | Johnston et al. |
| 6,895,792 | B2 | 5/2005 | Davis |
| 6,961,000 | B2 | 11/2005 | Chung |
| 7,002,467 | B2 | 2/2006 | Deconinck et al. |
| 7,053,774 | B2 | 5/2006 | Sedon et al. |
| 7,102,509 | B1 | 9/2006 | Anders et al. |
| 7,385,522 | B2 | 6/2008 | Belden, Jr. et al. |
| D579,318 | S | 10/2008 | Davis |
| 7,482,907 | B2 | 1/2009 | Denison et al. |
| 7,629,895 | B2 | 12/2009 | Belden, Jr. et al. |
| 7,698,916 | B2 | 4/2010 | Davis |
| 7,737,843 | B2 | 6/2010 | Belden, Jr. et al. |
| 7,737,844 | B2 | 6/2010 | Scott et al. |
| 7,737,845 | B2 | 6/2010 | Fawcett et al. |
| 7,737,846 | B2 | 6/2010 | Belden, Jr. et al. |
| 7,821,395 | B2 | 10/2010 | Dension et al. |
| 7,969,305 | B2 | 6/2011 | Belden, Jr. et al. |
| 8,542,119 | B2 | 9/2013 | Sankey |
| 8,884,762 | B2 | 11/2014 | Fawcett et al. |
| 8,890,691 | B2 | 11/2014 | Fawcett et al. |
| 8,896,447 | B2 | 11/2014 | Fawcett et al. |
| 8,994,497 | B2 | 3/2015 | Grant et al. |
| 9,135,800 | B2 | 9/2015 | Fawcett et al. |
| 9,171,441 | B2 | 10/2015 | Fawcett et al. |
| 9,269,247 | B2 | 2/2016 | Fawcett et al. |
| 9,396,631 | B2 | 7/2016 | Fawcett et al. |
| 9,478,110 | B2 | 10/2016 | Fawcett et al. |
| 9,501,913 | B2 | 11/2016 | Fawcett et al. |
| 9,576,452 | B2 | 2/2017 | Fawcett et al. |
| 9,659,472 | B2 | 5/2017 | Fawcett et al. |
| 9,858,778 | B2 | 1/2018 | Fawcett et al. |
| 9,984,524 | B2 | 5/2018 | Fares et al. |
| 10,013,867 | B2 | 7/2018 | Fawcett et al. |
| 10,062,266 | B1 | 8/2018 | Fawcett et al. |
| 10,087,659 | B2 * | 10/2018 | Grant ..... E05B 73/0047 |
| 10,403,122 | B2 | 9/2019 | Fawcett et al. |
| 2002/0024420 | A1 | 2/2002 | Ayala et al. |
| 2002/0024440 | A1 | 2/2002 | Okuno |
| 2002/0085343 | A1 | 7/2002 | Wu et al. |
| 2002/0185397 | A1 | 12/2002 | Sedon et al. |

(56) References Cited

U.S. PATENT DOCUMENTS

| | | | |
|---|---|---|---|
| 2003/0058083 | A1 | 3/2003 | Birchfield |
| 2003/0120922 | A1 | 6/2003 | Sun et al. |
| 2003/0156740 | A1 | 8/2003 | Siegel et al. |
| 2003/0179606 | A1 | 9/2003 | Nakajima et al. |
| 2003/0206106 | A1 | 11/2003 | Deconinck et al. |
| 2004/0003150 | A1 | 1/2004 | Deguchi |
| 2004/0046027 | A1 | 3/2004 | Leone |
| 2004/0046664 | A1 | 3/2004 | Labit et al. |
| 2004/0160305 | A1 | 8/2004 | Remenih et al. |
| 2004/0201449 | A1 | 10/2004 | Denison et al. |
| 2005/0073413 | A1 | 4/2005 | Sedon et al. |
| 2005/0077995 | A1 | 4/2005 | Paulsen et al. |
| 2005/0165806 | A1 | 7/2005 | Roatis et al. |
| 2005/0231365 | A1 | 10/2005 | Tester et al. |
| 2005/0242962 | A1 | 11/2005 | Lind et al. |
| 2007/0131005 | A1 | 6/2007 | Clare |
| 2007/0144224 | A1 | 6/2007 | Scott et al. |
| 2007/0146134 | A1 | 6/2007 | Belden et al. |
| 2007/0159328 | A1 | 7/2007 | Belden et al. |
| 2007/0194918 | A1 | 8/2007 | Rabinowitz |
| 2008/0224655 | A1 | 9/2008 | Tilley et al. |
| 2008/0252415 | A1 | 10/2008 | Larson et al. |
| 2009/0096413 | A1 | 4/2009 | Partovi et al. |
| 2009/0112739 | A1 | 4/2009 | Barassi et al. |
| 2010/0238031 | A1 | 9/2010 | Belden, Jr. et al. |
| 2011/0084799 | A1 | 4/2011 | Ficko |
| 2011/0254661 | A1 | 10/2011 | Fawcett et al. |
| 2012/0047972 | A1 | 3/2012 | Grant et al. |
| 2013/0081434 | A1 | 4/2013 | Grant et al. |
| 2014/0225733 | A1 | 8/2014 | Fawcett et al. |
| 2015/0137976 | A1 | 5/2015 | Fawcett et al. |
| 2016/0358431 | A1 | 12/2016 | Fawcett et al. |
| 2017/0069184 | A1 | 3/2017 | Fawcett et al. |
| 2017/0236401 | A1 | 8/2017 | Fawcett et al. |
| 2018/0102031 | A1 | 4/2018 | Fawcett et al. |
| 2018/0363332 | A1 | 12/2018 | Grant et al. |
| 2019/0003209 | A1 | 1/2019 | Grant et al. |
| 2020/0270911 | A1 | 8/2020 | Grant et al. |

FOREIGN PATENT DOCUMENTS

| | | | |
|---|---|---|---|
| CN | 101583983 | A | 11/2009 |
| CN | 103189902 | A | 7/2013 |
| DE | 4405693 | | 8/1995 |
| EP | 0745747 | A1 | 12/1996 |
| GB | 2353622 | A | 2/2001 |
| JP | H1-192970 | | 8/1989 |
| JP | 8279082 | | 10/1996 |
| JP | 1997-259368 | | 10/1997 |
| JP | 20142746 | A | 1/2014 |
| KR | 2001-0075799 | | 8/2001 |
| KR | 2002-0001294 | | 1/2002 |
| WO | 90/09648 | A1 | 8/1990 |
| WO | 97/031347 | | 8/1997 |
| WO | 99/23332 | A1 | 5/1999 |
| WO | 1999/047774 | | 9/1999 |
| WO | 2002/043021 | A2 | 5/2002 |
| WO | 2004/023417 | A2 | 3/2004 |
| WO | 2004/093017 | A1 | 10/2004 |
| WO | 2007075960 | A2 | 7/2007 |
| WO | 2015038201 | A1 | 3/2015 |

OTHER PUBLICATIONS

Petition for Inter Partes Review of U.S. Pat. No. 7,737,843, Mar. 20, 2014, 64 pages (IPR 2014-00457).

<http:/www.videx.com/AC_PDFs/Product%20Sheets/CK-GM.pdf>; "Grand Mastesr Key"; 2 pages.

<http:/www.lockingsystems.com/Pfd_Files/nexgen_xt_SFIC.pdf>; "SFIC Locks NEXGEN XT"; 1 page.

Supplementary European Search Report for related European Patent Application No. EP 06 845 868.6 filed Dec. 20, 2006; date of completion of the search May 7, 2010; 7 pages.

Supplementary European Search Report for related European Patent Application No. EP 06 847 982.3 filed Dec. 20, 2006; date of completion of the search May 7, 2010; 3 pages.

Supplementary European Search Report for related European Patent Application No. EP 06 845 865.2 filed Dec. 20, 2006; date of completion of the search May 12, 2010; 4 pages.

Ligong Li, The First Office Action for Chinese Patent Application No. 2012102534555 dated Dec. 16, 2013, Chinese Patent Office, Beijing, China.

Ziwen Li, The Sixth Office Action for Chinese Patent Application No. 2006800481876, dated Feb. 17, 2014, 7 pages, Chinese Patent Office.

C. Naveen Andrew, First Office Action for Indian Patent Application No. 3187/CHENP/2008, dated Jan. 27, 2015, 2 pages, Indian Patent Office, India.

Petition for Inter Partes Review of U.S. Pat. No. 9,135,800, Apr. 14, 2016, 66 pages (IPR2016-00895).

Petition for Inter Partes Review of U.S. Pat. No. 9,135,800, Apr. 14, 2016, 64 pages (IPR2016-00896).

Petition for Inter Partes Review of U.S. Pat. No. 8,884,762, Apr. 14, 2016, 63 pages (IPR2016-00892).

Petition for Inter Partes Review of U.S. Pat. No. 9,269,247, Apr. 14, 2016, 65 pages (IPR2016-00899).

Petition for Inter Partes Review of U.S. Pat. No. 9,269,247, Apr. 14, 2016, 65 pages (IPR2016-00898).

Petition for Inter Partes Review of U.S. Pat. No. 7,737,846, Jun. 21, 2016, 73 pages (IPR2016-01241).

Extended European search report for Application No. 15198379.8, dated Apr. 13, 2016, 7 pages, European Patent Office, Munich, Germany.

Petition for Inter Partes Review of U.S. Pat. No. 9,396,631, Nov. 29, 2016, 65 pages (IPR2017-00344).

Petition for Inter Partes Review of U.S. Pat. No. 9,396,631, Nov. 29, 2016, 63 pages (IPR2017-00345).

Schneier, Bruce, Applied Cryptography: Protocols, Algorithms, and Source Code in C, 1994, John Wiley & Sons, Inc., New York, NY, Table of Contents and Excerpts, 14 pages.

Petition for Inter Partes Review of U.S. Pat. No. 7,737,844, Sep. 30, 2016, 76 pages (IPR2016-01915).

Examination Report from related European Application No. 15198379.8, dated Jan. 23, 2017 (7 pages).

Petition for Inter Partes Review of U.S. Pat. No. 9,576,452 dated Jan. 12, 2018, 73 pages (IPR2018-00481).

Daher, John K., et al., "Test Concept and Experimental Validation of the Use of Built-In-Test to Simplify Conducted Susceptibility Testing of Advanced Technology Integrated Circuits and Printed Circuit Boards", 1990, Georgia Tech Research Institute, Georgia Institute of Technology, Atlanta, Georgia (5 pages).

New Webster's Dictionary and Thesaurus of the English Language, 1992, Lexicon Publications, Inc., Santa Barbara, California, Excerpt, p. 747.

McGraw-Hill Dictionary of Scientific and Technical Terms, Sixth Edition, 2003, The McGraw-Hill Companies, Inc., New York, New York, Excerpts, pp. 689-690, 1672.

McGraw-Hill Dictionary of Scientific and Technical Terms, Sixth Edition, 2003, The McGraw-Hill Companies, Inc., New York, New York, Excerpts, pp. 689-690, 1231.

Petition for Post-Grant Review of Claims 1-45 of U.S. Pat. No. 9,659,472, dated Oct. 17, 2017, 93 pages, (PGR2018-00004).

Final Written Decision for Inter Partes Review of U.S. Pat. No. 8,884,762, dated Sep. 28, 2017, 71 pages (IPR2016-00892).

Final Written Decision for Inter Partes Review of U.S. Pat. No. 9,269,247, dated Sep. 28, 2017, 78 pages (IPR2016-00898 and IPR2016-00899).

Final Written Decision for Inter Partes Review of U.S. Pat. No. 9,135,800, dated Oct. 12, 2017, 82 pages (IPR2016-00895 and IPR2016-00896).

Petition for Inter Partes Review of U.S. Pat. No. 9,478,110, Jul. 31, 2017, 68 pages (IPR2017-01900).

Clements, Alan. Computer Organization and Architecture: Themes and Variations, 2014. Cengage Learning, Stamford, CT, Excerpts, 4 pages.

(56) References Cited

OTHER PUBLICATIONS

Petition for Inter Partes Review of U.S. Pat. No. 9,478,110, Jul. 31, 2017, 71 pages (IPR2017-01901).
Final Written Decision for Inter Partes Review of U.S. Pat. No. 7,737,844, dated Mar. 28, 2018, 51 pages (IPR2016-01915).
Final Written Decision for Inter Partes Review of U.S. Pat. No. 7,737,846, dated Dec. 19, 2017, 34 pages (IPR2016-01241).
International Search Report and Written Opinion from corresponding International Application No. PCT/US2015/058941, dated Jan. 27, 2016 (8 pages).
Final Written Decision from Inter Partes Review Nos. IPR2017-00344 and IPR2017-00345 of U.S. Pat. No. 9,396,631, dated May 24, 2018 (94 pages).
Corrected Petition from Inter Partes Review No. IPR2018-01138 of U.S. Pat. No. 9,659,472 dated May 22, 2018 (71 pages).
Extended European Search Report from corresponding European Patent Application No. 15862110.2, dated Jul. 4, 2018 (9 pages).
First Office Action from corresponding Chinese Patent Application No. 2015800627966, dated Nov. 5, 2018 (10 pages).
Petition for Inter Partes Review of U.S. Pat. No. 10,062,266, dated Aug. 28, 2019, 75 pages (IPR2018-01553).
Final Written Decision from Inter Partes Review of U.S. Pat. No. 9,576,452, dated Jul. 16, 2019, 55 pages (IPR2018-00481).
Patent Owner's Preliminary Response from Inter Partes Review of U.S. Pat. No. 9,269,247, dated Jul. 19, 2016, 57 pages (IPR2016-00898).
Complaint from Civil Action No. 1:18-cv-02653, Southern District of Indiana, dated Aug. 28, 2018 (15 pages).
Excerpts, "Newton's Telecom Dictionary: The Official Dictionary of Telecommunications Networking and Internet." 16th Edition, 2000, CMP Books, 2000.
Decision Denying Institution of Inter Partes Review of U.S. Pat. No. 10,062,266, dated Mar. 6, 2020, 30 pages (IPR2019-01553).
Final Written Decision of Inter Partes Review of U.S. Pat. No. 9,748,110, dated Feb. 12, 2019, 71 pages (IPR2017-01900 and IPR2017-01901).
Final Written Decision of Inter Partes Review of U.S. Pat. No. 9,659,472, dated Dec. 5, 2019, 55 pages (IIPR2018-01138).

* cited by examiner

KEY AND SECURITY DEVICE

CROSS REFERENCE TO RELATED APPLICATIONS

The present application is a continuation of U.S. application Ser. No. 16/872,981, filed on May 12, 2020, which is a continuation of U.S. application Ser. No. 16/110,843, filed on Aug. 23, 2018, which is a continuation of U.S. application Ser. No. 15/526,194, filed on May 11, 2017, and now U.S. Pat. No. 10,087,659, which is a 371 national phase entry of International Application No. PCT/US2015/058941, filed Nov. 4, 2015, which claims the benefit of U.S. Provisional Application No. 62/081,233, filed Nov. 18, 2014, the contents of which are incorporated by reference herein in its entirety.

BACKGROUND OF THE INVENTION

Embodiments of the present invention relate generally to keys and security devices of the type used to display an item of merchandise vulnerable to theft.

It is common practice for retailers to display items of merchandise on a security device. The security device displays an item of merchandise so that a potential purchaser may examine the item when deciding whether to purchase the item. The small size and relative expense of the item, however, makes the item an attractive target for shoplifters. A shoplifter may attempt to detach the item from the security device, or alternatively, may attempt to remove the security device from the display area along with the merchandise. In some instances, the security device is secured to a display support using a lock operated by a key, for example, a mechanical lock. In other instances, the security device is secured to the display support using a lock operated by an electronic key to arm and disarm the security device.

BRIEF SUMMARY OF THE INVENTION

Embodiments of the present invention are directed to keys, security devices, security systems, and method for securing items of merchandise from theft. In one embodiment, a key for a security device is provided. The key includes an electronic component configured to communicate with one or more security devices to initially receive one or more codes associated with each of the security devices. The key also includes a memory configured to store the one or more codes associated with the one or more security devices. The electronic component is configured to communicate with each of the one or more security devices for arming and/or disarming the security devices upon a matching of the code stored by the memory with the code associated with the security device.

In another embodiment, a security system is provided. The security system includes one or more security devices each comprising a monitoring circuit and a code. The security system also includes one or more keys each comprising an electronic component configured to communicate with the one or more security devices to initially receive one or more codes associated with each of the security devices. Each key further includes a memory configured to store the one or more codes associated with the one or more security devices. The electronic component is configured to communicate with each of the one or more security devices for arming and/or disarming the security devices upon a matching of the code stored by the memory with the code associated with the one or more security devices.

According to another embodiment, a method for securing items of merchandise is provided. The method includes communicating with one or more security devices to initially receive and store one or more codes associated with each of the one or more security devices. In addition, the method includes subsequently communicating with each of the one or more security devices for arming and/or disarming the one or more security devices upon a matching of the code stored with the code associated with the one or more security devices.

In another embodiment, a security device for an item of merchandise is provided. The security device includes an electronic component configured to communicate with one or more keys to initially receive one or more codes associated with each of the keys. The security device also includes a memory configured to store the one or more codes associated with the one or more keys. The electronic component is configured to communicate with each of the one or more keys for arming and/or disarming the security device upon a matching of the code stored by the memory with the code associated with the one or more keys.

BRIEF DESCRIPTION OF THE DRAWINGS

The detailed description of the invention provided below may be better understood with reference to the accompanying drawing figures, which depict one or more embodiments of a security device and method.

DETAILED DESCRIPTION OF THE INVENTION

Referring now to the accompanying drawing figures, one or more embodiments of a key 10 for cooperating with a security device 12 are shown. The security device 12 may be one of the type commonly used to display one or more articles of merchandise (not shown for purposes of clarity) within a display area of a retail store. By way of example, and not by limitation, the security device 12 is a merchandise display hook for displaying relatively, small, expensive consumer products, for example, compact discs (CDs), digital video discs (DVDs), battery packs, etc., on a display support. The display support could be any suitable support, such as wire grid, horizontal bar rack, slatwall (also known as slatboard), wall, table, desk, countertop or other secure structure. Other examples of a security device 12 according to the present invention without limitation include merchandise display fixtures, merchandise tags (or "bugs"), stop locks, cable locks and wraps, and merchandise safers. In some embodiments, the security device 12 may be a display module, a puck, or an alarm that is mountable to a display surface, support, or the like, for displaying an item of merchandise (see, e.g., FIG. 4). The item of merchandise may be a display model or an operational sample of electronic merchandise, such as cellular telephones, portable computers (e.g., notebooks, laptops, tablets, etc.), e-readers, media players, and the like, for a customer to examine before making a decision to purchase the item. The item of merchandise may be displayed in a manner that permits a prospective purchaser to evaluate the operation and features of the merchandise, while protecting the merchandise from a potential thief. In some example embodiments, the security devices 12 are similar to the Locking Hooks, Smart Locks, and PODs manufactured by InVue Security Products Inc.

Figure 1:
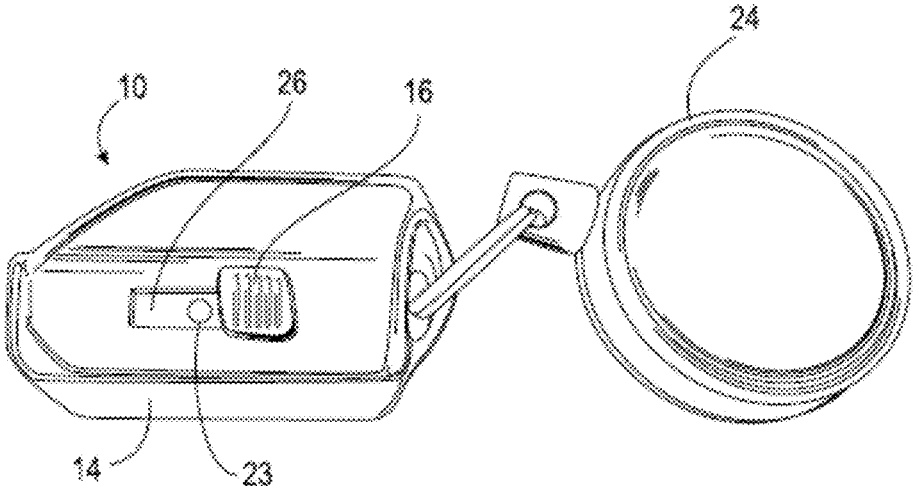
FIG. 1 illustrates a key according to one embodiment of the present invention.
Figure 2:
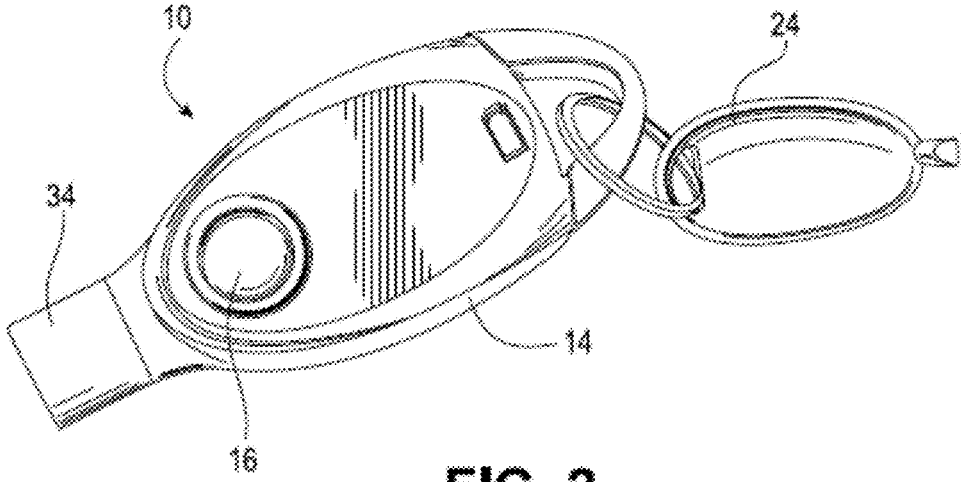
FIG. 2 illustrates a key according to another embodiment of the present invention.

In one embodiment, a key 10 for a security device 12 is provided and generally includes a housing 14 and an actuation member 16 operably engaged with the housing (see, e.g., FIGS. 1 and 2). For example, the actuation member 16 may be at least partially disposed within the housing 14. The key 10 further includes an electronic component 20 operably engaged with the actuation member 16 and configured to cooperate with a security device 12 (see, e.g., FIG. 3). In some embodiments, the electronic component 20 comprises communication capability for communicating with the security device 12. Similarly, the security device 12 may include an electronic component 38 configured to communicate with the key 10. The actuation member 16 may be configured to move and/or activate the electrical component 20 for cooperation with the security device 12, and the actuation member 16 may be configured to be locked upon expiration of a predetermined period of time or number of activations such that the actuation member is unable to actuate the electrical component for cooperating with the security device. Thus, upon expiration of a particular period of time or number of activations, the key 10 is unable to be used to lock/arm or unlock/disarm a security device 12. In this way, stolen keys will be rendered useless after a predetermined period of time or activations. In addition, the key 10 can be used interchangeably with different types of security devices 12 such that a user is only required to carry one key. Thus, the key 10 may be "multi-purpose" in that the key may be used for different lock types (e.g., mechanical locking hooks, electronic locks, display modules, keepers, cable locks, etc.).

Figure 5:
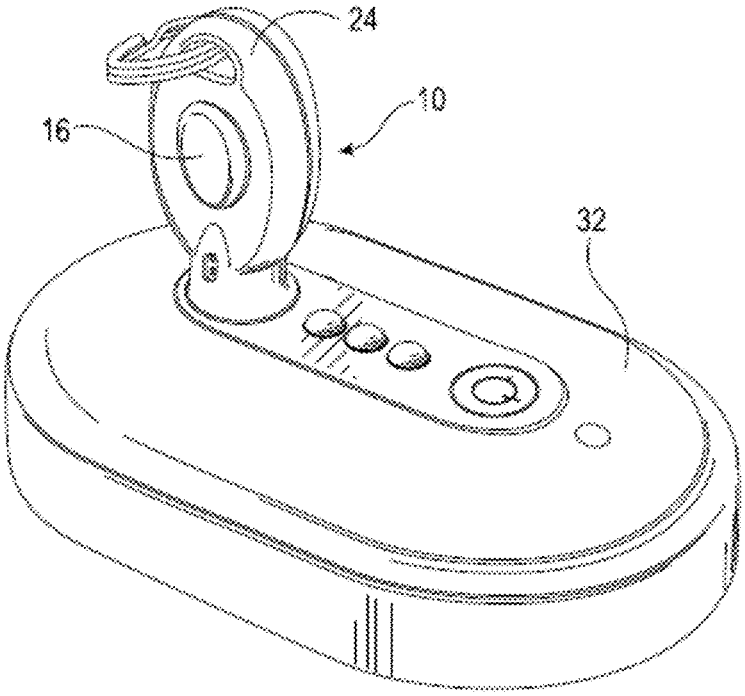
FIG. 5 is a perspective view of a key engaged with a programming station according to one embodiment of the present invention.

The housing 14 may be any suitable housing configured to at least partially receive the electrical component 20, as well as the actuation member 16, therein. For example, the housing 14 may be a single piece design or may include a plurality of components joined into a unitary member (e.g., via snap fit, fasteners, adhesive, and/or molding). In one example, the housing 14 includes two halves that are joined together to define an internal cavity. The housing 14 may define an internal cavity for accommodating various components, including the electrical component 20, the actuation member 16, and/or the locking mechanism 23. The housing 14 may also house various other components, such as a controller, a logic control circuit, or a printed circuit board, a battery, and/or an EAS tag. The housing 14 may also be coupled to various other optional components, such as a keychain 24, lanyard, or the like (see, e.g., FIGS. 1, 2, and 5). The housing 14 may be a variety of sizes and configurations, and may be suitably sized for placement within a user's pocket or on a key chain. The housing 14 may include an opening or channel 26 defined therein for receiving the actuation member 16. For instance, the actuation member 16 may be a manually operated button that is operable by the user and is operably engaged with the electrical component 20.

The actuation member 16 may be any device, mechanism, or feature that is configured to actuate the electrical component 20. For example, the actuation member 16 may be a manually actuated member, such as a push button, sliding mechanism, or the like. Alternatively, the actuation member 16 may be an automatically actuated member, such as an actuation member driven by a motor. The automatic actuation may occur, for example, in response to a user depressing a button or activating a switch. The actuation member 16 may be in communication with a logic control circuit, controller, or PCB of the key for actuating the actuation member in response to a signal from the logic control circuit, controller, or PCB.

Similar to the actuation member 16, the locking mechanism 23 may be a mechanical and/or electrical locking mechanism. Thus, as used herein, the term "locking mechanism" should be broadly construed to include any device, mechanism, or feature that physically locks, secures or protects the key 10 from further use. For example, the locking mechanism 23 could be a physical barrier that prevents the actuation member 16 and/or electrical component 20 from being displaced relative to the housing 14 or otherwise actuated to lock/arm or unlock/disarm a security device 12. Or, the locking mechanism 23 may be an electrically or an electro-mechanically controlled mechanism, such as a motor driven mechanism that is actuated to prevent the actuation member 16 and/or the electrical component 20 from being displaced or otherwise operated. Alternatively, the locking mechanism 23 could render the actuation member 16 inoperable such that the actuation member is incapable of being actuated. The locking mechanism 23 may be in communication with a logic control circuit, controller, or PCB of the key 10 such that the locking mechanism is configured to be actuated to lock or unlock the actuation member 16 in response to a signal from the logic control circuit, controller, or PCB.

In some cases, the actuation member 16 and the locking mechanism 23 may be separate components, while in other cases the actuation member and the locking mechanism may be integrated into a single component or otherwise operably engaged with one another. For example, where the actuation member 16 is a motor driven actuator, the locking mechanism 23 may also be operated via the motor driven actuator such that actuation of the motor in one direction actuates the electrical component 20 while actuation of the motor in an opposite direction or de-actuation of the motor locks the mechanical and/or electrical components.

Figure 3:
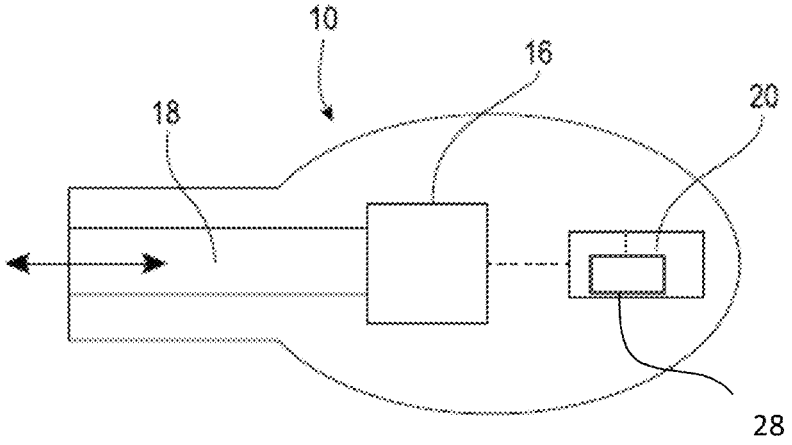
FIG. 3 illustrates a schematic view of a key according to one embodiment of the present invention.

In some embodiments, the key 10 may include a mechanical component 18 and an electrical component 20 (see, e.g., FIG. 3). For example, the mechanical component 18 may be configured to cooperate with a security device 12 having a mechanical member, such as, for example, a lock mechanism, a latch, or the like. In one embodiment, the mechanical component 18 may be configured to extend outwardly from the housing 14 to disengage a mechanical member of a security device 12, as well as retract relative to the housing 14. Thus, the mechanical component 18 could be a protrusion, extendable member, or the like that is configured to engage a mechanical member of the security device 12. In other embodiments, the mechanical component 18 facilitates communication between the electronic component 20 and the security device 12. For example, the mechanical component 18 may include one or more electrical contacts or allowing communication between the key 10 and the security device 12.

Figure 4:
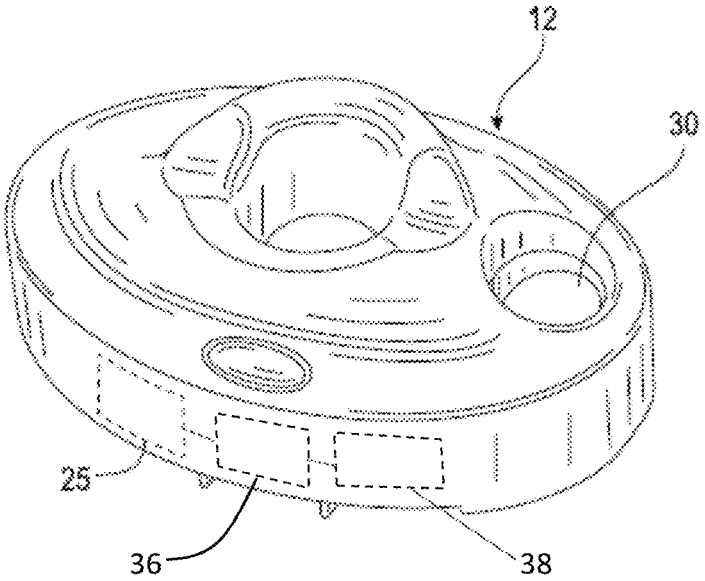
FIG. 4 is a perspective view of a security device according to one embodiment of the present invention.

The electrical component 20 may be configured to cooperate with a security device 12 for arming and/or disarming a monitoring circuit 25 that is in electrical communication with the security device (see, e.g., FIG. 4). For example, the electrical component 20 may be configured for various forms of wireless communication with a security device 12, such as optical (e.g., infrared), acoustical (e.g. ultrasonic), radiofrequency (RF), or magnetic pulse. In one embodiment, data and/or power is transferred from the key 10 to the security device 12 by wireless communication, such as by infrared (IR) optical transmission, as shown and described in U.S. Pat. Nos. 7,737,843, 7,737,845, U.S. Publication No. 2011/0254661, and U.S. Patent Publication No. 2012/0047972, each of which is incorporated herein by reference in its entirety. In other cases, communication between the key 10 and the security device 12 may occur via wired means (e.g., electrical contacts) or other suitable communication means.

In some embodiments, the security device 12 may be programmed with an identification code, a security code, or the like. For example, each security device 12 may include a memory 36 that stores a particular code specific to the security device. The code may be programmed in the security device by the manufacturer or the retailer in some embodiments. Similarly, the key 10 may include a memory 28 for storing a code. The key 10 may be configured to be positioned within or proximate to a transfer port 30 of the security device 12, and the actuation member 16 may be depressed to activate communication of the security code between the key and the security device. In some cases, communication may occur automatically upon engagement of the key 10 with the security device 12, with or without actuation of an actuation member 16, or the security device may be actuated for communicating with the key. FIG. 4 shows one embodiment of a security device 12 including a transfer port 30 that is configured to communicate with a key 10. The key 10 may include a transfer probe 34 that is configured to be positioned proximate to, engaged with, or aligned with the transfer port 30 for facilitating communication therebetween. The security code may be wirelessly communicated between the security device 12 and the key 10 by infrared (IR) optical transmission. Alternatively, the security code may be transmitted and received by electrical contacts, acoustic transmission (e.g., RF signals), or magnetic induction.

In the event that the security code of the key 10 matches the security code of the security device 12, the key may then be permitted to arm and/or disarm the security device 12 and/or transfer electrical power to the security device, for example, to operate a lock mechanism of the security device. The key 10 may transfer electrical power to the security device 12 in any suitable manner, such as by electrical contacts, acoustical transmission (e.g. RF signals) or magnetic induction. Further discussion regarding data and electrical communication between an electronic key 10 and a security device 12 may be found, for example, in U.S. Publication No. 2012/0047972, which is hereby incorporated by reference in its entirety. It is understood that in other embodiments, the key 10 may only transfer a signal to arm and/or disarm the security device 12 and does not transfer electrical power to the security device.

The key 10 and/or the security device 12 may be programmed with a security code. The key 10 and/or the security device 12 may each be pre-programmed with the same code into a respective permanent memory. Alternatively, the key 10 may first be programmed with the code via communication with the security device 12. Thus, the key 10 may not have any stored code prior to communicating with the security device 12. For instance, the key 10 may be configured to communicate with one or more security devices 12 and store each of the codes in its memory 28. Thus, the key 10 may initially receive the codes from the security devices 12. The key 10 may be configured to store a plurality of codes such that the key may communicate with each of the security devices 12 associated with such codes for arming and/or disarming the security devices. In other embodiments, the security device 12 may be first programmed with a code via communication with one or more keys 10. Thus, the security device 12 may store one or more codes associated with each of the keys 10. In some embodiments, the key 10 and/or the security device 12 may be pre-programmed with a code or may be self-programming in other embodiments.

As discussed above, in one embodiment, the key 10 may include a time-out function. More particularly, the ability of the actuation member 16 to actuate the electrical component 20 may be deactivated after a predetermined time period or activations. The key 10 may be reactivated by communicating with a programming station 32, i.e., the key is "refreshed". By way of example, the key 10 may include a logic control circuit that is configured to be deactivated after about six to twelve hours (e.g., about eight hours) from the time the key was last refreshed by a programming station 32. In one embodiment, an authorized sales associate is required to refresh the key 10 assigned to him or her at the beginning of each work shift. Thus, the key 10 would have to be refreshed by a programming station 32, which is typically monitored or maintained at a secure location, in order to reactivate the logic control circuit of the key. Other forms for refreshing the code may be used such as, for example, inputting a code, charging the key with an authorized charger, etc. The key 10 may be provisioned with a single-use (e.g., non-rechargeable) internal power source, such as a conventional or extended-life battery. Alternatively, the key 10 may be provisioned with a multiple-use (e.g., rechargeable) internal power source, such as a conventional capacitor or rechargeable battery.

In some embodiments, the key 10 is configured to communicate with a plurality of security devices 12 for initially programming the key with respective codes for each of the security devices. Thus, the key 10 may be initially programmed by communicating with the security devices 12. Such programming could be carried out for a predetermined period of time and once the time has expired, the key 10 stores all codes associated with the security devices 12 for which it can communicate with for arming and/or disarming thereof. After the programming of the key 10 has been completed, the key may then communicate with each security device 12 to arm and/or disarm the security device upon the code communicated by the key matching the code stored by the security device. Alternatively, the security device 12 may communicate with a plurality of keys 10 for receiving and storing respective codes for each of the keys. Therefore, in some cases, the programming station 32 is not required to program the key 10 and/or the security device 12. In some embodiments as discussed above, the programming station 32 may be used to refresh the key 10. Thus, the programming station 32 may only be employed to refresh the key 10 after the key has timed out but does not otherwise function to program a code into the key.

The foregoing has described one or more embodiments of a key for a security device or security packaging of the type commonly used to display an item of merchandise, a security device, and a system. Embodiments of a key, security device, and system have been shown and described herein for purposes of illustration. Those of ordinary skill in the art, however, will readily understand and appreciate that numerous variations and modifications of the invention may be made without departing from the spirit and scope of the invention.

That which is claimed is:

1. A security system comprising:

a programming station;

a plurality of security devices each comprising a memory configured to store a pre-programmed code; and a plurality of keys each comprising a memory configured to store a pre-programmed code, each of the plurality of keys having a different pre-programmed code, wherein each of the plurality of keys is configured to communicate with any one of the plurality of security devices for controlling the security device when the pre-programmed code of the key matches the pre-programmed code of the security device, wherein any one of the plurality of keys is configured to communicate with the programming station for reauthorizing the key, and wherein the programming station does not program the pre-programmed code in each of the plurality of keys.

2. The security system of claim 1, wherein the programming station is not configured to program the plurality of security devices.

3. The security system of claim 1, wherein each of the plurality of keys is configured to disarm any one of the plurality of security devices using the pre-programmed code.

4. The security system of claim 1, wherein the pre-programmed code of each of the plurality of keys is programmed by a manufacturer of the key.

5. The security system of claim 1, wherein the memory of each of the plurality of keys comprises a permanent memory for storing the pre-programmed code.

6. The security system of claim 1, wherein the pre-programmed code of each of the plurality of keys is an identification code.

7. The security system of claim 1, wherein each of the plurality of keys comprises a predetermined number of activations for controlling the plurality of security devices, wherein the programming station is configured to communicate with any one of the plurality of keys to reactivate the key after the predetermined number of activations.

8. The security system of claim 7, wherein an activation comprises a communication between any one of the plurality of keys and any one of the plurality of security devices.

9. The security system of claim 1, wherein each of the plurality of keys is configured to communicate with the same programming station for reauthorizing the key.

10. A method for securing items of merchandise from theft, the method comprising:

storing a different code in a memory of each of a plurality of keys;

programming each of a plurality of security devices with a different code;

disarming any one of a plurality of security devices when any one of the plurality of keys is activated and the code stored by the key matches the code of the security device; and reauthorizing any one of the plurality of keys using a programming station, wherein the programming station does not program the different codes in the plurality of keys.

11. The method of claim 10, wherein disarming comprises communicating between one of the plurality of keys and one of the plurality of security devices.

12. The method of claim 10, wherein disarming comprises transferring a signal from one of the plurality of keys to disarm one of the plurality of security devices.

13. The method of claim 10, wherein disarming comprises establishing communication in response to engagement of one of the plurality of keys with one of the plurality of security devices.

14. The method of claim 10, wherein disarming comprises activating any one of the plurality of keys to disarm any one of the plurality of security devices.

15. The method of claim 10, further comprising storing a predetermined number of activations in a memory of each of the plurality of keys.

16. The method of claim 15, wherein disarming comprises activating one of the plurality of keys to disarm one of the plurality of security devices if the key has not exceeded the predetermined number of activations.

17. The method of claim 10, wherein reauthorizing comprises refreshing any one of plurality of keys using the programming station following a predetermined number of activations.

18. The method of claim 10, wherein reauthorizing comprises reactivating any one of plurality of keys using the programming station following a predetermined number of activations.

19. The method of claim 10, wherein activating comprises activating any one of plurality of keys to disarm a monitoring circuit associated with any one of the plurality of security devices using the code of the key.

20. The method of claim 10, wherein reauthorizing comprises reauthorizing each of the plurality of keys using the same programming station.

* * * * *